United States Patent [19]

Schopp et al.

[11] 4,310,134

[45] Jan. 12, 1982

[54] STEP LADDER UTILITY BOX

[76] Inventors: Anthony L. Schopp, 655 Ruth St., Bridgeport, Conn. 06606; George N. Macol, Jr., 80 Weber Ave., Bridgeport, Conn. 06610

[21] Appl. No.: 143,432

[22] Filed: Apr. 24, 1980

[51] Int. Cl.[3] ..... E06C 7/14

[52] U.S. Cl. ..... 248/210; 248/311.2

[58] Field of Search ..... 248/210, 211, 238, 311.2, 248/360; 182/121, 122; 15/257.06

[56] References Cited

U.S. PATENT DOCUMENTS

| | | | |
|---|---|---|---|
| 2,490,546 | 12/1949 | Rubin | 15/257.06 |
| 2,694,825 | 11/1954 | Touchett | 248/211 X |
| 3,408,030 | 10/1968 | Krechman | 248/311.2 X |
| 3,669,396 | 6/1972 | Gantzler | 248/210 X |
| 4,032,100 | 6/1977 | Kahn | 248/211 |

FOREIGN PATENT DOCUMENTS

| | | | |
|---|---|---|---|
| 492458 | 2/1930 | Fed. Rep. of Germany | 248/210 |
| 2536329 | 2/1977 | Fed. Rep. of Germany | 248/210 |

*Primary Examiner*—J. Franklin Foss

*Attorney, Agent, or Firm*—Martin D. Wittstein

[57] ABSTRACT

A utility box for tools, parts and the like which is adapted to be placed upon and removably secured to the top platform typically provided at the top of a step ladder. The box includes a bottom wall, two side walls and two end walls forming a rectangular receptacle having approximately the same dimensions as the platform of the step ladder. A plurality of resilient retaining clips are attached to the box and are shaped to press against the lower surface of the bottom wall, the clips having sufficient resilience so that they can be opened and will press against the lower surface of the step ladder platform when the box is positioned thereon.

2 Claims, 5 Drawing Figures

FIG. 1
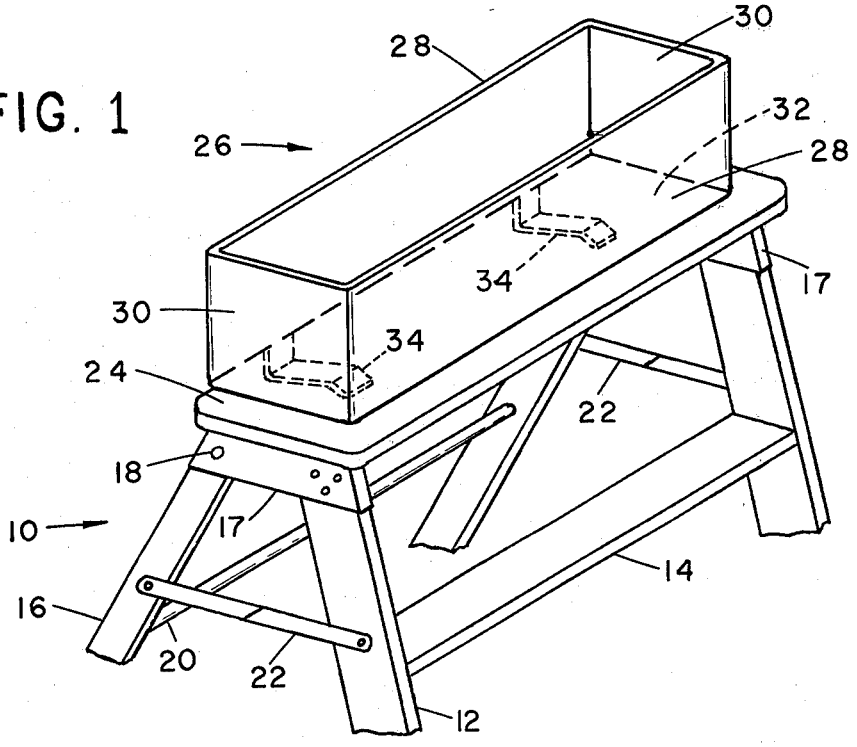
FIG. 2
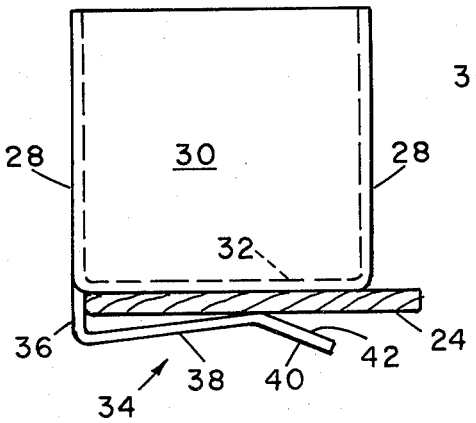
FIG. 3
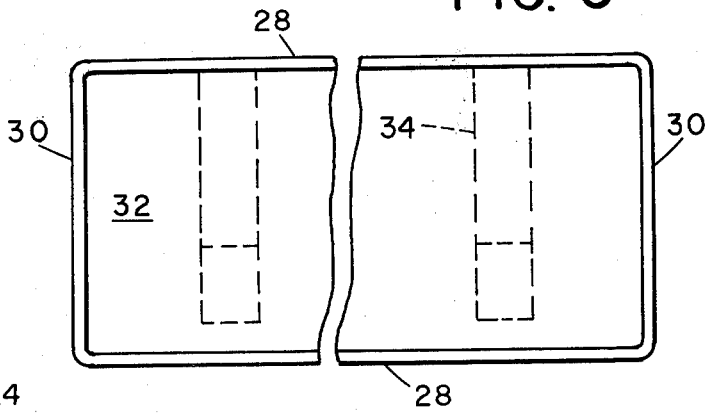
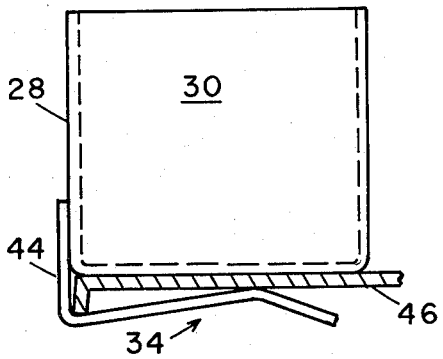
FIG. 4
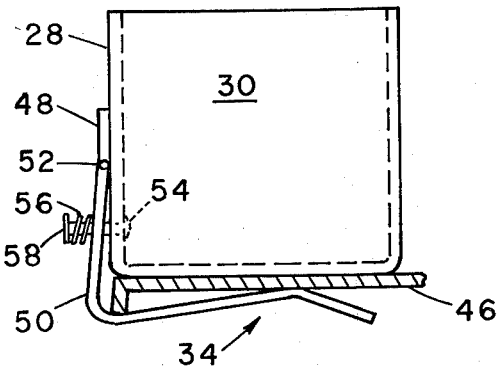
FIG. 5

STEP LADDER UTILITY BOX

BACKGROUND OF THE INVENTION

As is generally known, a step ladder is a device which enables an individual to reach up to heights which are not otherwise attainable. Typically a step ladder is used by people in general to be able to reach articles which are otherwise out of reach, or it is used by workers to attain the height necessary to perform work on objects or structures which are otherwise out of reach.

While the foregoing is true of any type of ladder, a step ladder is typically used by craftsmen such as plumbers, electricians, carpenters and other types of artesans who generally perform their work inside of a residential or commercial building. A step ladder is ideal for such interior work because it is very stable by virtue of its four-legged construction and therefore suitable for manufacture in a variety of sizes typically ranging from about four to ten feet in height. Although step ladders are made in larger sizes, and although they are used out of doors where they require fairly level ground to maintain stability, their primary use seems to be indoors by individuals as mentioned above.

A step ladder is generally made to be light and portable, so that it can easily be moved from place to place within a work area without folding the ladder to its flat configuration. This is especially important in connection with the design of a step ladder, which is free standing and self-supporting, and therefore does not require any other form of support to hold it in position for use as does, for example, an extension ladder. However, a user who wants to move the ladder frequently must remove from the ladder anything which he may have placed on it, such as tools and the like, or these objects are likely to fall to the floor.

The type of people mentioned above who most frequently use a step ladder usually must have readily available tools, parts and other things such as tapes, rules, etc. which are necessary for the performance of their tasks. Typically these tools and other objects are relatively small and the user desires to have them within reach at all times so that he does not have to come down or get off of the ladder while performing a task simply to obtain a tool or a part or to change from one tool to another, etc. Many artesans have adopted the practice of wearing a tool belt, a belt having loops, straps, pockets, etc. which are fashioned to be able to hold various types of tools and other implements of the trade. Tool belts are very handy devices for use for people when walking around from place to place while performing their work, but they are not especially convenient to use while standing on a ladder. For one thing, the tool belt and tools may interfere with the wearer being able to maintain a properly balanced position on the ladder. For another, it is frequently inconvenient to reach a desired tool or implement on the belt without assuming an awkward position on the ladder. Both of these factors can contribute significantly to a potentially dangerous situation leading to falls and consequent injury.

Thus, it is far more preferable for the craftsman to have his tools and other implements directly in front of him, on the ladder and within easy reach while he is on the ladder. Accordingly, many craftsmen place tool boxes or utility boxes containing tools and parts on the top platform of the step ladder. While this is a very convenient arrangement, it has the disadvantage that the box can very easily slide off the top of the step ladder while the ladder is being moved for the reason that it is somewhat difficult to move a step ladder which is locked in the open position and still maintain the top platform sufficiently level to support the utility box. It takes little imagination to comprehend the frustration, anger and unnecessary tension experienced by a worker who moves his ladder and drops his utility or tool box in the process with the result that tools, parts and other articles are spread all over the floor, possibly with some breakage. The time spent in picking up tools and parts is time lost from the job, and this usually means lost revenue if the worker is receiving a fixed amount of money for the particular job.

BRIEF SUMMARY OF THE INVENTION

The present invention relates generally to utility boxes and more particularly to a utility box which is adapted to be received on and secured to the top platform of a conventional step ladder.

The present invention obviates or substantially eliminates the many problems discussed above by providing a utility box which is designed, configurated and dimensioned to be placed on the top platform of a conventional step ladder and to be secured thereto so that it cannot readily slide off of the top platform during use or movement of the ladder. Briefly, the present invention comprises a box-like device having a bottom wall, two side walls and two end walls all suitably connected together to form a rigid construction. The box is generally rectangular in horizontal cross-section so as to generally correspond to the flat dimensions of the step ladder platform. The box is provided with a plurality of retaining clips which are connected to the bottom or to one side wall of the box and which are adapted to engage with the lower surface of the top platform in order to securely retain the box in proper position on the upper surface of the platform. The retaining clips are designed to have a certain degree of resilience, and may either be formed integrally with the box or be rigidly or pivotally connected to the box by suitable spring means, so that the retaining clips will exert sufficient pressure on the lower surface of the step ladder platform to maintain the utility box in place even if the step ladder is tipped to a substantial degree.

It is a principal object of the present invention to provide a utility box adapted to be securely mounted on the top platform of a conventional step ladder.

It is another object of the present invention to provide a utility box which can very easily and quickly be securely mounted on the top platform of a conventional step ladder and be removed therefrom just as easily and quickly.

It is still another object of the present invention to provide a utility box which can be securely mounted on the top platform of a step ladder and which is inexpensive to manufacture, simple to use and requires no maintenance.

These and other objects, advantages and features of the present invention will be more readily appreciated from an understanding of the following detailed description of preferred embodiments of the present invention when considered in conjunction with the accompanying drawings in which:

FIG. 1 is a perspective view of a utility box constructed in accordance with the principles of the present invention and shown in operative position on a conventional step ladder, of which only a portion is shown;

FIG. 2 is an end view of the utility box shown in FIG. 1 showing one form of attaching clip;

FIG. 3 is a top view of the utility box shown in FIG. 1;

FIG. 4 is an end view of the utility box shown in FIG. 1 but illustrating a different form of attaching clip; and FIG. 5 is an end view of the utility box shown in FIG. 1 but illustrating yet another form of attaching clip.

DETAILED DESCRIPTION OF THE INVENTION

Referring now to the drawings and particularly to FIG. 1 thereof, the reference numeral 10 generally indicates a conventional step ladder with which the utility box of the present invention is intended to be used. The ladder 10 comprises a first frame 12 which supports a plurality of vertically spaced apart steps 14. A second frame 16 is pivotally connected by any suitable means such as the bracket 17 being rigidly connected to the frame 12 and the frame 14 being pivotally connected as at 18 to the bracket 17 such that when the two frames are disposed at an angle they are self standing. The second frame 16 includes any desired arrangement of bracing 20 to impart sufficient rigidity to the second frame to help maintain the ladder secure when it is in use. Any suitable form of folding bracket or hinged connecting device 22 interconnects the first and second frames so that they can be locked open at a predetermined angle when the ladder is in use.

The frames 12 and 16 are appropriately shaped adjacent the location where they are pivotally connected together to support a platform 24 which is generally rectangular in configuration and dimensioned slightly larger than the steps 14. Occasionally a person will use the platform 24 as a step although it is not intended for this purpose and it is dangerous to do so. Therefore the platform is generally available as a convenient support for tools and other articles so long as there is some way of confining them to the platform.

This latter function is accomplished by the utilty box of the present invention, generally designated by the reference numeral 26. The box comprises a pair of elongate side walls 28 and a pair of end walls 30, all suitably joined together to form an enclosure, and these walls are joined to a bottom wall 32 thereby forming a rectangular box. The dimensions of the foregoing walls are such as to define a rectangular box which is of approximately the same size as the platform 24 forming the top of the ladder 10 or perhaps slightly smaller. Thus the utility box could be offered in a variety of sizes which are selected in order to provide boxes adaptable for use with ladders of different size.

The utility box is secured to the platform 24 by means of a plurality of resilient retaining devices 34 which are either formed integrally with, or are secured to, a portion of the utility box, and, as seen in FIG. 1, are spaced along the bottom wall 32 of the utility box to contact the lower surface of the platform 24. Although two such retaining clips are shown in FIG. 1, any desired number of such clips may be provided depending on the holding capability which is desired.

FIG. 2 illustrates one form of resilient clip 34 which is connected to the lower edge of the box 26 and may be formed integrally therewith, particularly if the box is formed of molded plastic. The clip 34 includes a depending portion 36 which extends downwardly for a distance greater than the thickness of the platform 24, and a laterally extending portion 38 which is normally bent upwardly to press forcibly on the lower surface of the platform 24. The clip 34 has a further lateral portion 40 which extends downwardly at an angle to the first lateral portion 38 so as to form a camming surface 42 which is presented to the edge of the step ladder platform so that the clips are forced open and away from the bottom wall 32 of the box when the box is placed on the platform 24. It will be understood that there is sufficient resilience in the spring clip itself and in the connection thereof with the box to permit the clip to move away from the bottom of the box and press forcibly against the underside of the platform 24 to retain the box thereon.

FIG. 4 illustrates another embodiment of the invention in which the clips 34 are connected to one of the long walls 28 of the box rather than to the lower edge of the box. The clip has a depending portion 44 which extends part way up the wall 28 and may be secured thereto by any fastening device, spot welding, adhesives, etc. The box also is shown in this view as being secured to the platform of an aluminum ladder in which case the platform 46 is much thinner than the wooden platform 24 and typically has a depending flange 48 extending around the periphery of the platform. In all other respects the clip 34 shown in FIG. 4 is constructed the same as that shown in FIG. 2 and functions in the same manner.

FIG. 5 illustrates still another embodiment of the invention in which the retaining clips 34 are connected to the wall 28 of the box by means of a hinge and are resiliently urged into operative engagement with the underside of the platform. Thus, each clip has an upper portion 48 connected to the box wall 28 by any suitable connecting means such as those mentioned above. A lower depending portion 50 is connected to the upper portion 48 by a hinge 52 so that the lower portion of the clip can pivot toward and away from the box. A pin 54 is suitably connected to the box wall 28 and extends through an aperture formed in the depending portion 50. A compression spring 56 is captured between the outer surface of the lower portion 50 of the clip and a suitable retaining clip 58 mounted on the pin 54 so as to forcibly urge the clip 34 into contact with the lower surface of the platform. This embodiment of the invention is preferred in those situations where it is desired to have a very substantial force urging the clips 34 into engagement such as with large boxes which can hold a substantial amount of weight.

We claim:

1. A utility box for holding tools and the like and adapted to be placed on and secured to the top platform of a step ladder, said utility box comprising:

A. a bottom wall having a generally rectangular configuration such that said bottom wall will be substantially close to the dimensions of the generally rectangular top platform of a step ladder, B. a pair of side walls and a pair of end walls connected to said bottom wall to form a receptacle having the dimensions of said bottom wall, so that said receptacle will normally remain in position on said top platform of its own weight when placed thereon, and C. resilient retaining means secured to said utility box and extending laterally beneath said bottom wall, said resilient retaining means comprising a plurality of clips secured to said utility box adjacent the intersection of said bottom wall and one of said side walls, said clips having a depending portion which extends downwardly from said intersection of said bottom wall with said one of said side walls for a distance greater than the thickness of the top platform of the step ladder and a laterally extending portion which is normally bent upwardly to press forcibly on the undersurface of said bottom wall, whereby said utility box is fastened to the top platform of the step ladder and is maintained securely thereon.

2. A utility box as set forth in claim 1 wherein said depending portion of said clips are pivotally connected to said side wall of said utility box and there are spring means interposed between said depending portion of said clips and said side wall for forcibly urging said depending portion of said clips toward said side wall to maintain said laterally extending portion of said clips in contact with the lower surface of said bottom wall.

* * * * *